US006001529A

United States Patent [19]

Imai

[11] Patent Number: 6,001,529

[45] Date of Patent: Dec. 14, 1999

[54] THERMAL RECORDING PROCESS

[75] Inventor: Shinji Imai, Minamiashigara, Japan

[73] Assignee: Fuji Photo Film Co., Ltd., Kanagawa-ken, Japan

[21] Appl. No.: 08/964,878

[22] Filed: Nov. 5, 1997

[30] Foreign Application Priority Data

Nov. 18, 1996 [JP] Japan ..... 8-306821

[51] Int. Cl.[6] ..... G03C 5/56

[52] U.S. Cl. ..... 430/138; 430/332; 430/333; 430/335; 430/346; 430/349; 430/945; 430/964

[58] Field of Search ..... 430/138, 333, 430/335, 346, 349, 964, 332, 945

[56] References Cited

U.S. PATENT DOCUMENTS

| | | | |
|---|---|---|---|
| 4,383,261 | 5/1983 | Goldberg | 430/349 |
| 4,388,400 | 6/1983 | Tabei et al. | 430/346 |
| 4,745,046 | 5/1988 | Borrer et al. | 430/333 |
| 5,104,767 | 4/1992 | Nakamura | 430/349 |
| 5,409,797 | 4/1995 | Hosoi et al. | 430/349 |
| 5,627,007 | 5/1997 | Van den Bergh et al. | 430/346 |
| 5,629,130 | 5/1997 | Leenders et al. | 430/964 |
| 5,725,989 | 3/1998 | Chang et al. | 430/964 |
| 5,804,355 | 9/1998 | Bosschaerts et al. | 430/349 |

FOREIGN PATENT DOCUMENTS

| | | |
|---|---|---|
| 50-23617 | 3/1975 | Japan . |
| 58-94494 | 6/1983 | Japan . |
| 61-291183 | 12/1986 | Japan . |
| 62-77983 | 4/1987 | Japan . |
| 62-78964 | 4/1987 | Japan . |
| 524219 | 2/1993 | Japan . |
| 5301447 | 11/1993 | Japan . |

*Primary Examiner*—Richard L. Schilling
*Attorney, Agent, or Firm*—Sughrue, Mion, Zinn, Macpeak & Seas, PLLC

[57] ABSTRACT

The speed at which a thermosensitive recording medium is scanned with a laser beam is selected to be 5 m/s or higher to increase the temperature of a thermosensitive layer of the thermosensitive recording medium for recording a gradation image thereon with high sensitivity. A sharp temperature gradient is produced along the thickness of the thermosensitive layer, so that a density gradient along the thickness of the thermosensitive layer is developed, therefore, a high-quality image can be recorded without producing any density irregularities caused by thickness irregularities of the thermosensitive layer.

5 Claims, 7 Drawing Sheets

THERMAL RECORDING PROCESS

BACKGROUND OF THE INVENTION

1. Field of the Invention

The present invention relates to a thermal recording process for recording a gradation image on a thermal recording medium with a laser beam.

2. Description of the Related Art

Thermal recording apparatus for applying thermal energy to a thermosensitive recording medium to record an image or other information thereon are in wide use. Particularly, thermal recording apparatus which employ a laser output source as a thermal energy source for high-speed recording are known from Japanese laid-open patent publications Nos. 50-23617, 58-94494, 62-77983, and 62-78964, for example.

The applicant has developed a thermal recording medium capable of recording a high-quality image for use in such thermal recording apparatus. The thermosensitive recording medium comprises a support base coated with a coloring agent, a color developer, and light-absorbing dyes (photothermal converting agent), and produces a color whose density depends on the thermal energy that is applied to the thermosensitive recording medium. For details, reference should be made to Japanese laid-open patent publications Nos. 5-301447 and 5-24219.

The thermosensitive recording medium has a thermosensitive layer on the support. The thermosensitive layer is produced by coating a coating solution on the support base. The coating solution contains an emulsion which is prepared by dissolving microcapsules containing at least a basic dye precursor, a color developer outside of the microcapsules, and light-absorbing dyes outside of the microcapsules into an organic solvent that is either slightly water-soluble or water-insoluble, and then emulsifying and dispersing the dissolved materials.

The basic dye precursor produces a color by donating electrons or accepting protons as of an acid or the like. The basic dye precursor comprises a compound which is normally substantially colorless and has a partial skeleton of lactone, lactam, sultone, spiropyran, ester, amide, or the like, which can be split or cleaved upon contact with the color developer. Specifically, the compound may be crystal violet lactone, benzoil leucomethylene blue, malachite green lactone, rhodamine B lactam, 1,3,3-trimethyl-6'-ethyl-8'-butoxyindolino-benzospiropyran, or the like.

The color developer may be of an acid substance such as a phenolic compound, an organic acid or its metal salt, oxybenzoate, or the like. The color developer should preferably have a melting point ranging from 50° C. to 250° C. Particularly, it should be of a slightly water-soluble phenol or organic acid having a melting point ranging from 60° C. to 200° C. Specific examples of the color developer are disclosed in Japanese laid-open patent publication No. 61-291183.

The light-absorbing dyes should preferably comprise dyes which absorb less light in a visible spectral range and have a particularly high rate of absorption of radiation wavelengths in an infrared spectral range. Examples of such dyes are cyanine dyes, phthalocyanine dyes, pyrylium and thiopyrylium dyes, azulenium dyes, squarylium dyes, metal complex dyes containing Ni, Cr, etc., naphtoquinone and anthraquinne dyes, indophenol dyes, indoaniline dyes, triphenylmethane dyes, triallylmethane dyes, aminium and diimmonium dyes, nitroso compounds, etc. Of these dye materials, those which have a high radiation absorption rate in a near-infrared spectral range whose wavelength ranges from 700 nm to 900 nm are particularly preferable in view of the fact that practical semiconductor lasers have been developed for generating near-infrared laser radiation.

In order to keep the thermosensitive recording medium in stable storage, the thermosensitive recording medium is designed such that it does not produce a color at a thermal energy level which is lower than a certain threshold value. Therefore, the laser output source is required to produce a considerable level of thermal energy for enabling the thermosensitive recording medium to produce a desired color. The thermosensitive recording medium may be scanned with a laser beam at a low speed to apply a sufficient level of light energy for thereby generating a sufficient level of thermal energy. However, the low-speed scanning lowers the recording efficiency. In addition, an increase in the laser output power for increasing the level of thermal energy will increase the cost of the thermal recording apparatus.

The thermosensitive recording medium tends to suffer thickness irregularities of the thermosensitive layer in the manufacturing process, and such thickness irregularities are responsible for irregularities in recorded images which cannot be ignored. While this drawback can be alleviated to some extent by increasing the accuracy with which to manufacture the thermosensitive recording medium, any required expenditure of time and money will be prohibitively large.

SUMMARY OF THE INVENTION

It is a major object of the present invention to provide a method of thermally recording high-quality irregularity-free gradation images on a thermosensitive recording medium efficiently with increased sensitivity, while avoiding an increase in the cost of a thermal recording apparatus used and also an increase in the accuracy with which to manufacture the thermosensitive recording medium.

A general object of the present invention is to provide a method of thermally recording gradation images at high speed with a minimum level of light energy required.

Another object of the present invention is to provide a method of thermally recording high-quality gradation images on a thermosensitive recording medium irrespectively of thickness irregularities of a thermosensitive layer of the thermosensitive recording medium.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
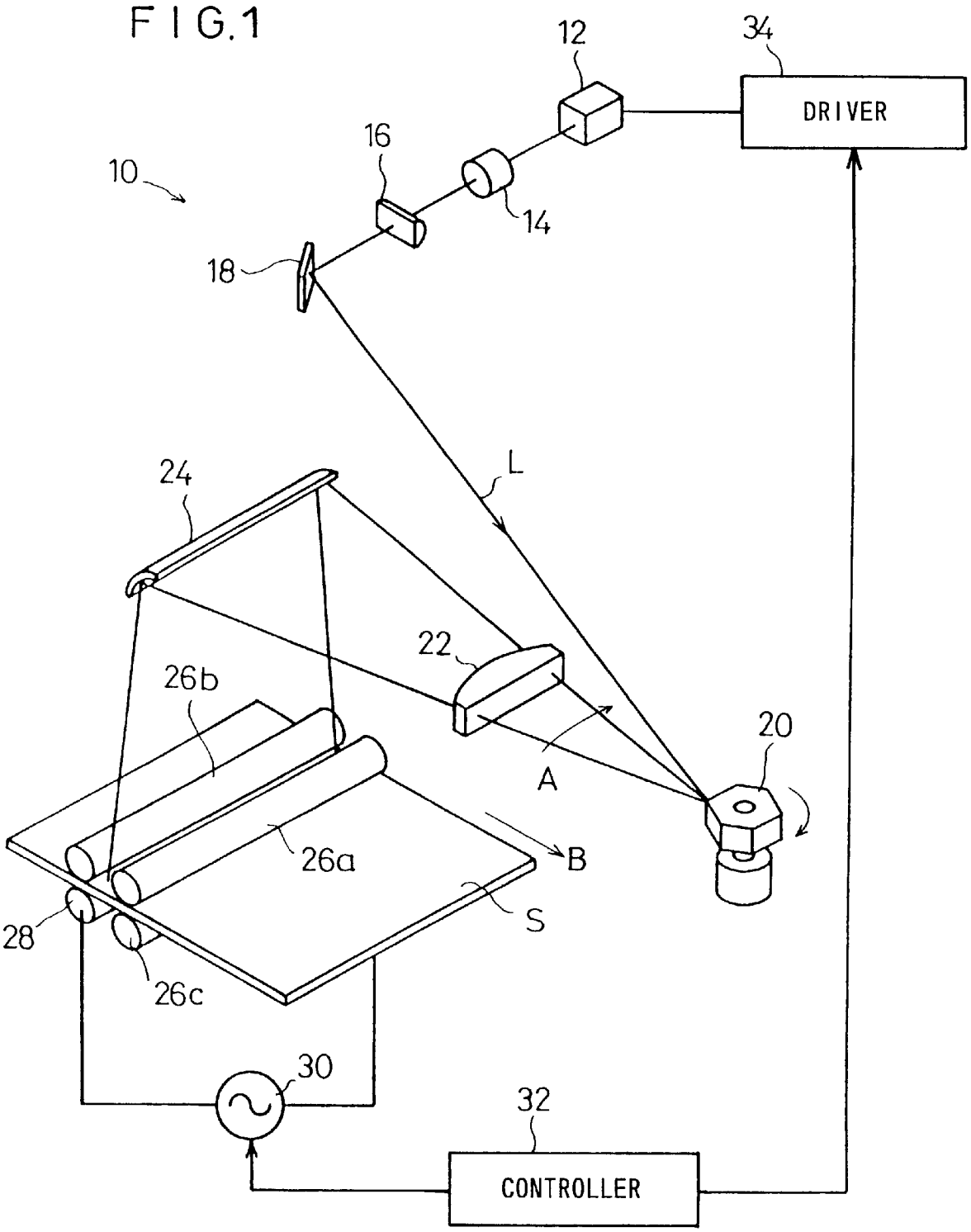
FIG. 1 is a schematic perspective view, partly in block form, of a thermal recording apparatus which is used to carry out a thermal recording process according to the present invention.

FIG. 1 schematically shows a thermal recording apparatus 10 which is used to carry out a thermal recording process according to the present invention. As shown in FIG. 1, the thermal recording apparatus 10 scans a thermosensitive recording medium S with a laser beam L in a main scanning direction indicated by the arrow A while the thermosensitive recording medium S is being fed in an auxiliary scanning direction indicated by the arrow B, for recording a gradation image on the thermosensitive recording medium S.

The thermal recording apparatus 10 comprises a laser diode 12 for emitting a laser beam L, a collimator lens 14 for converting the laser beam L into a parallel laser beam L, a cylindrical lens 16 for passing the laser beam L therethrough, a reflecting mirror 18 for reflecting the laser beam L, a polygonal mirror 20 for deflecting the laser beam L, an fθ lens 22 for passing the laser beam L therethrough, and a cylindrical mirror 24 for reflecting the laser beam L to correct a facet error of the polygonal mirror 20 in coaction with the cylindrical lens 16.

The thermal recording apparatus 10 also includes a pair of rollers 26*a*, 26*b* held in rolling contact with an upper surface of the thermosensitive recording medium S, a roller 26*c* held in rolling contact with a lower surface of the thermosensitive recording medium S for feeding the thermosensitive recording medium S in the auxiliary scanning direction B in coaction with the roller 26*a*, a preheating roller 28 held in rolling contact with the lower surface of the thermosensitive recording medium S for supplying a predetermined level of preheating energy to the thermosensitive recording medium S to preheat same, and a power supply 30 for supplying a current to the preheating roller 28 to preheat the thermosensitive recording medium S. The power supply 30 is controlled by a controller 32. The laser diode 12 is also controlled by the controller 32 through a driver 34.

Figure 2:
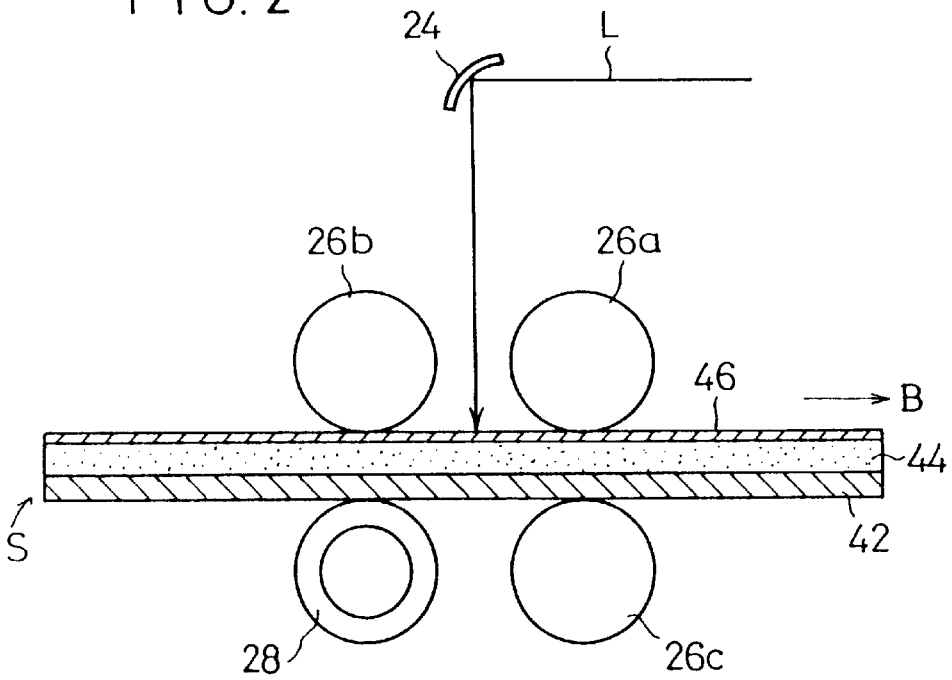
FIG. 2 is a vertical cross-sectional view of a recording section and a thermosensitive recording medium used in the thermal recording apparatus shown in FIG. 1.
Figure 3:
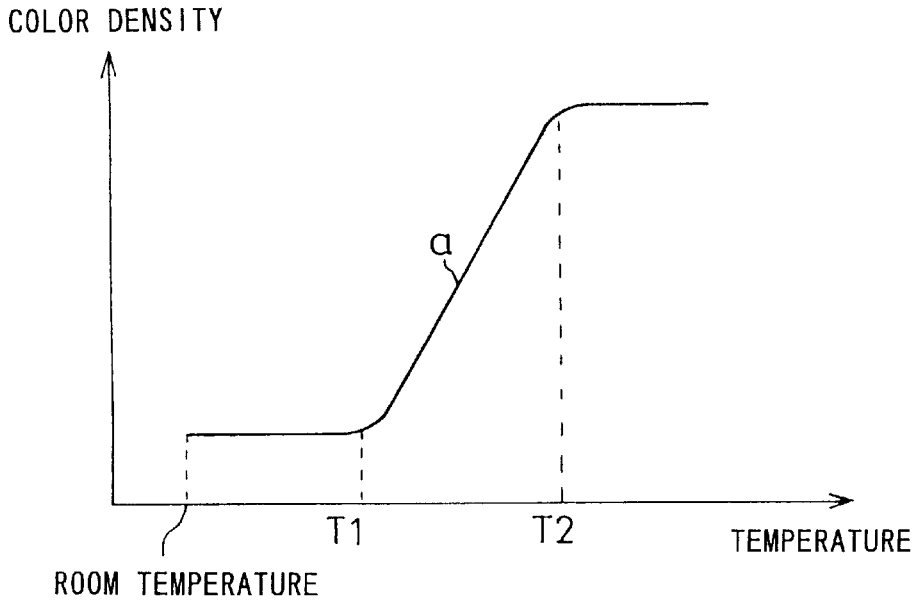
FIG. 3 is a diagram showing a coloring characteristic curve of the thermosensitive recording medium.

As shown in FIG. 2, the thermosensitive recording medium S comprises a support base 42, a transparent thermosensitive layer 44 disposed on the support base 42 and containing a coloring agent, a color developer, and a photothermal converting agent, and a protective layer 46 disposed on the transparent thermosensitive layer 44. The coloring agent is accommodated in microcapsules whose permeability to the color developer increases with thermal energy imparted from the photothermal converting agent. The coloring agent reacts to a certain extent with the color developer which is made flowable by the applied thermal energy for thereby achieving a desired color density. FIG. 3 schematically shows a coloring characteristic curve "a" of the thermosensitive recording medium S with respect to the temperature. As shown in FIG. 3, the thermosensitive recording medium S develops a color having a given density between temperatures T1, T2 which are higher than a room temperature. The thermosensitive layer 44 may be made of materials as disclosed in Japanese laid-open patent publications Nos. 5-301447 and 5-24219 referred to above.

Operation of the thermal recording apparatus 10 will be described below.

The thermosensitive recording medium S is preheated by the preheating roller 28 while being fed in the auxiliary scanning direction B by the roller 26*b*, the preheating roller 28, and the rollers 26*a*, 26*c*. Specifically, when a current is supplied from the power supply 30 to the preheating roller 28, the thermosensitive recording medium S is preheated to the temperature T1 beyond which the thermosensitive recording medium S will develop a color.

After the thermosensitive recording medium S is preheated, the controller 32 controls the driver 34 to energize the laser diode 12. The laser diode 12 emits a laser beam L which is modulated depending on the gradations of an image to be recorded on the thermosensitive recording medium S. The emitted laser beam L is converted by the collimator lens 14 into a parallel laser beam L, which is led to the polygonal mirror 20 through the cylindrical lens 16 and the reflecting mirror 18. The polygonal mirror 20, which is rotating at a high speed, reflects the laser beam L with its mirror facets and deflects the laser beam L in the main scanning direction A. The reflected and deflected laser beam L passes through the fθ lens 22 and is reflected by the cylindrical mirror 24 so as to be applied to the thermosensitive recording medium S through a slit between the rollers 26*a*, 26*b*. The laser beam L now scans the thermosensitive recording medium S in the main scanning direction B while the thermosensitive recording medium S is being fed in the auxiliary scanning direction B. The speed at which the laser beam L scans the thermosensitive recording medium S is selected to be of 5 m/s or higher for reasons described later on.

The light energy of the laser beam L applied to the thermosensitive recording medium S is converted into thermal energy by the photothermal converting agent contained in the thermosensitive layer 44. The thermal energy thus produced increases the permeability of the microcapsules to the color developer and makes the color developer flowable, whereupon the coloring agent accommodated in the microcapsules and the color developer react with each other, forming a gradation image of given color densities. Since the thermosensitive recording medium S has been preheated to the temperature T1 by the preheating roller 28, the laser beam L is only required to heat the thermosensitive recording medium S in a temperature range between the temperatures T1, T2. Therefore, the laser diode 12 does not need to have a high output power requirement, but the thermosensitive recording medium S is still capable of forming an accurate, high-quality gradation images thereon.

The reasons why the speed at which the laser beam L scans the thermosensitive recording medium S is selected to be of 5 m/s or higher will be described below.

Figure 4:
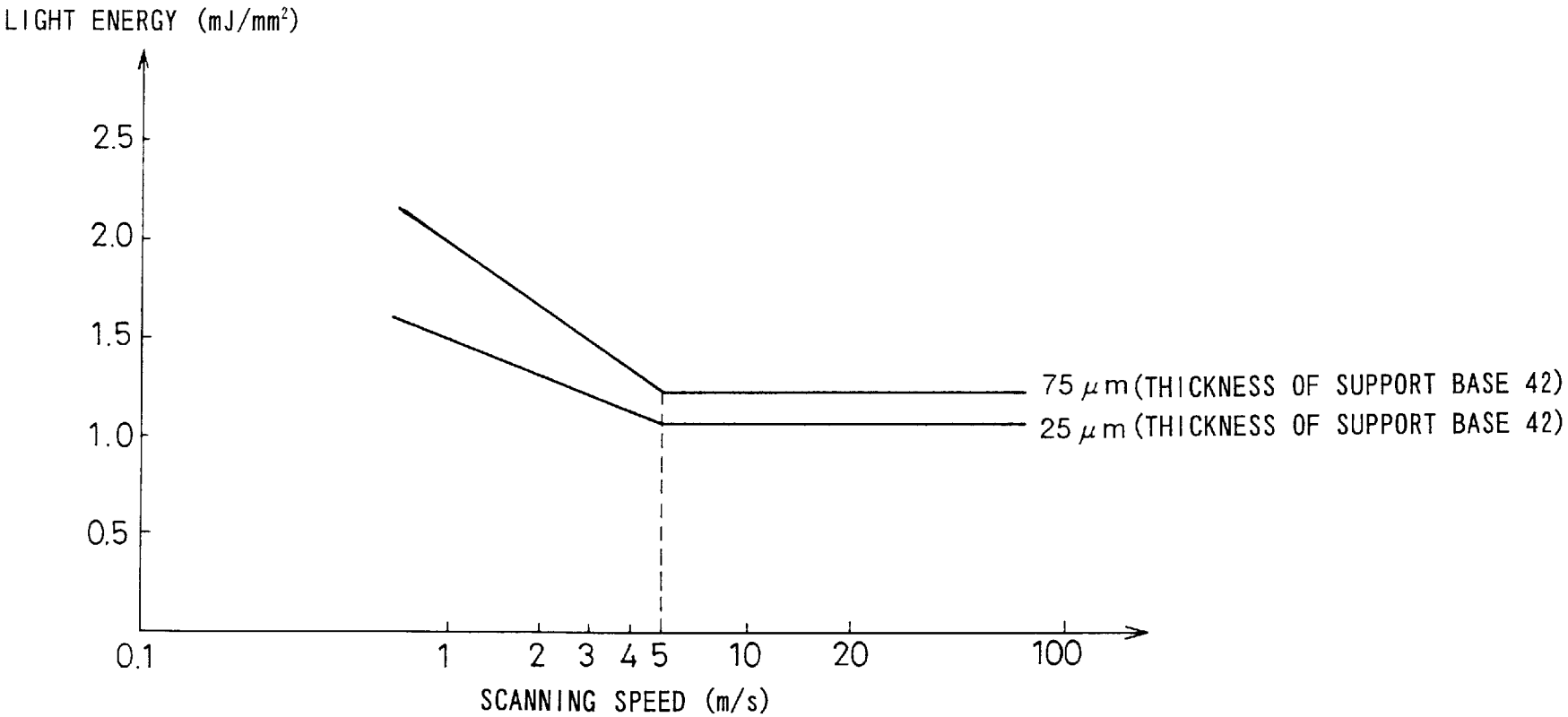
FIG. 4 is a diagram showing the relationship between the scanning speed of a laser beam and light energy required to achieve an optical density of 3.0.

FIG. 4 shows the relationship between the scanning speed of the laser beam L and the sensitivity of two thermosensitive recording mediums S with their support bases 42 having different thicknesses. The graph shown in FIG. 4 has a horizontal axis representing the scanning speed and a vertical axis representing light energy of the laser beam L required to achieve a coloring density of 3.0 (i.e., an optical density considered to make the thermosensitive recording medium S sufficiently black). As shown in FIG. 4, the required light energy decreases as the scanning speed increases, and becomes constant when the scanning speed is of about 5 m/s or higher. The lower limit of the scanning speed where the light energy becomes constant remains the same irrespective of the thickness of the support base 42. Therefore, the sensitivity of the thermosensitive recording medium S may be made maximum when the speed at which the laser beam L scans the thermosensitive recording medium S is of 5 m/s or higher.

Figure 5:
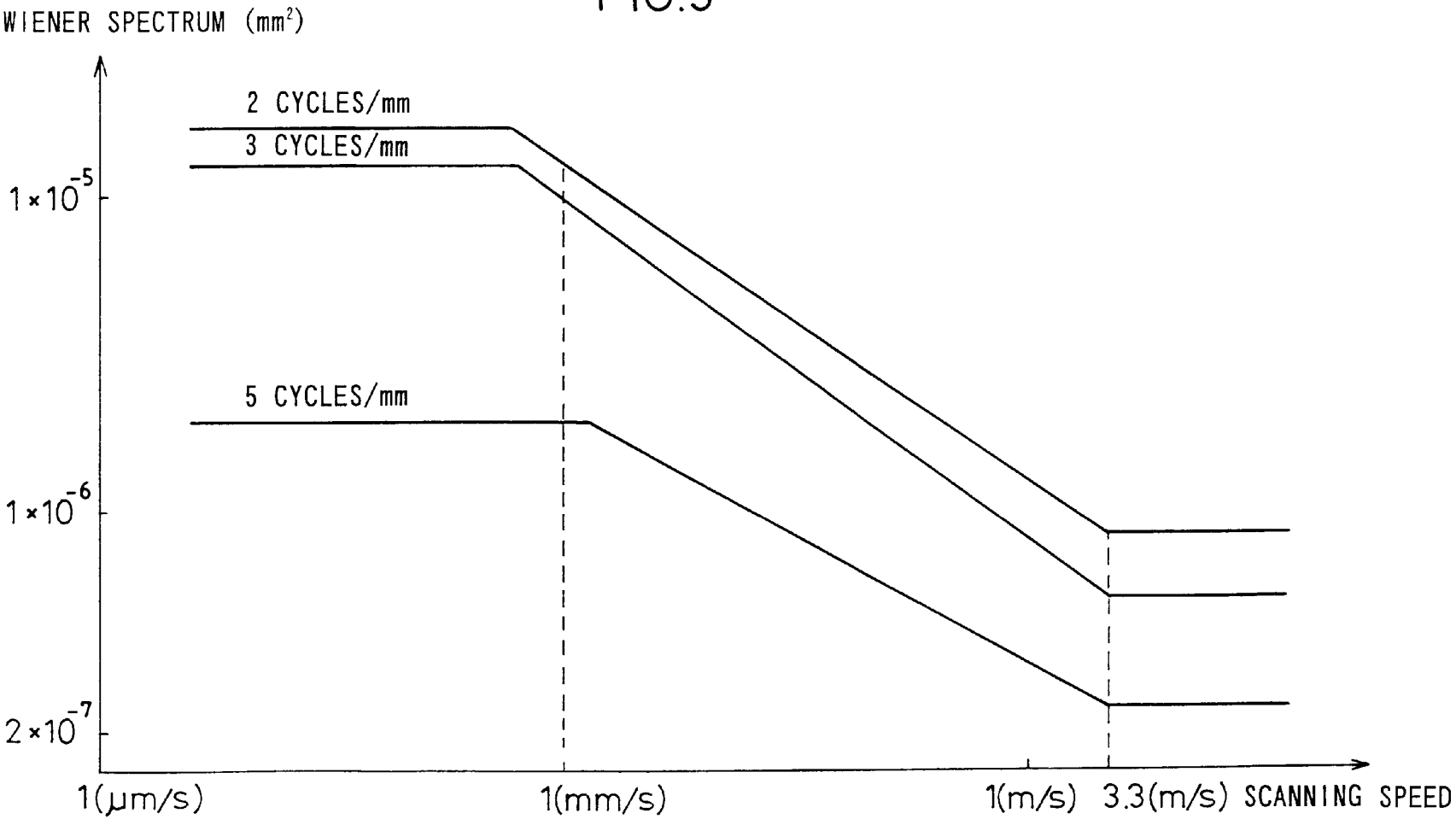
FIG. 5 is a diagram showing the relationship between the scanning speed of a laser beam and a Wiener spectrum of an image having an average optical density of 1.0.

FIG. 5 shows the relationship between the scanning speed of the laser beam L and the granularity at different spatial frequencies of a test image having an optical density of 1.0. The graph shown in FIG. 5 has a horizontal axis representing the scanning speed and a vertical axis representing a Wiener spectrum (power spectrum) which is produced by a Fourier transform of a noise (irregularity) component of an image whose average coloring density is 1.0 (i.e., an optical density which is an intermediate density considered to make the image granularity visible). The Wiener spectrum is of large constant values when the scanning speed is of about 1 mm/s or less, becomes lower as the scanning speed increases, and is of low constant values when the scanning speed is of about 3.3 mm/s or greater. The lower limit of the scanning speed where the values of the Wiener spectrum become constant remains the same regardless of the spatial frequencies of the test image. Consequently, the granularity of images formed on the thermosensitive recording medium S, i.e., irregularities of images which are caused by thickness irregularities of the thermosensitive layer 44 that are developed when the thermosensitive recording medium S is coated and dried, can be held to a minimum when the scanning speed of the laser beam L is of 3.3 m/s or greater.

Figure 6:
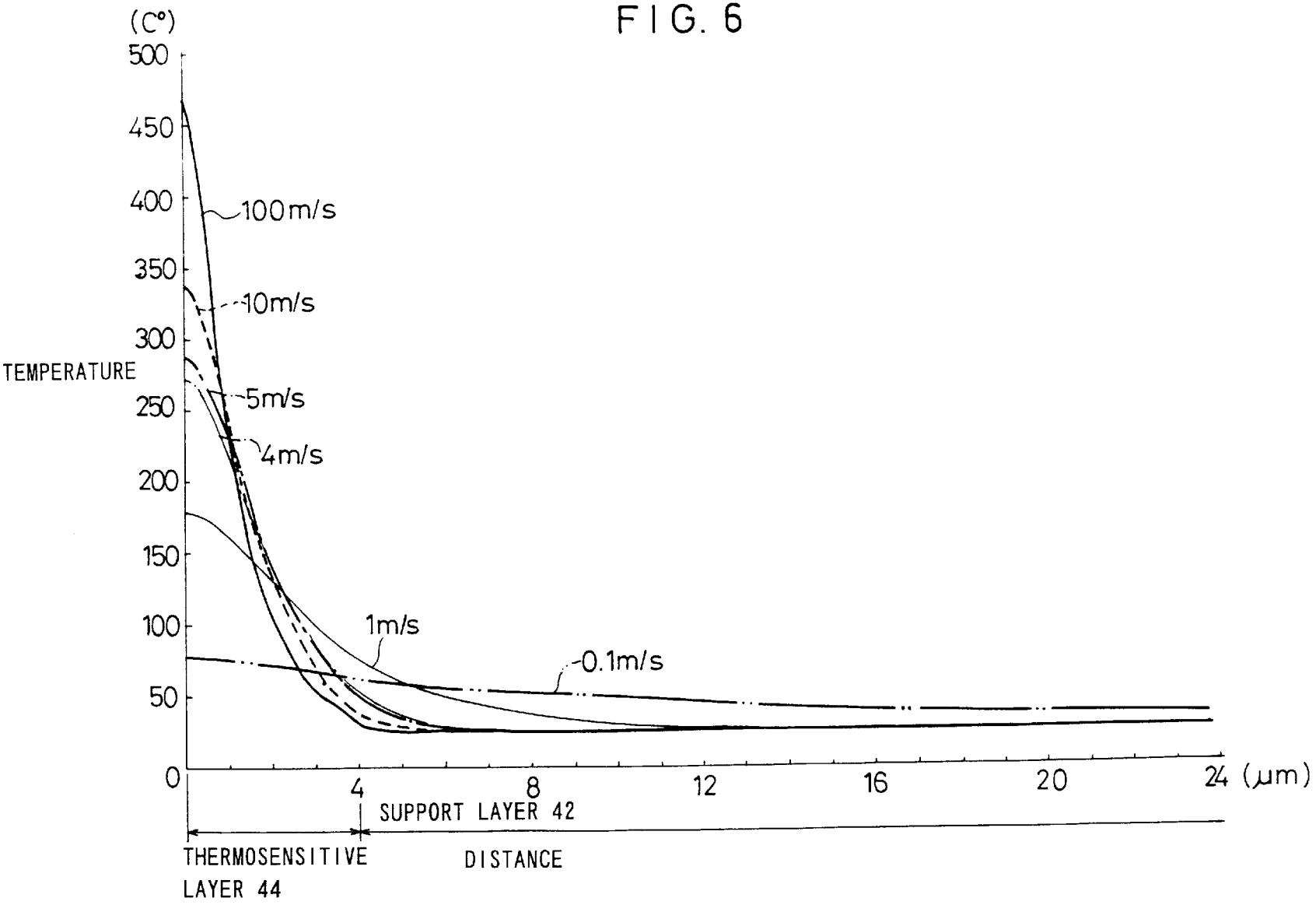
FIG. 6 is a diagram showing the relationship between the distance from the surface of a thermosensitive recording medium having a thickness of 4 μm and the temperature.
Figure 7:
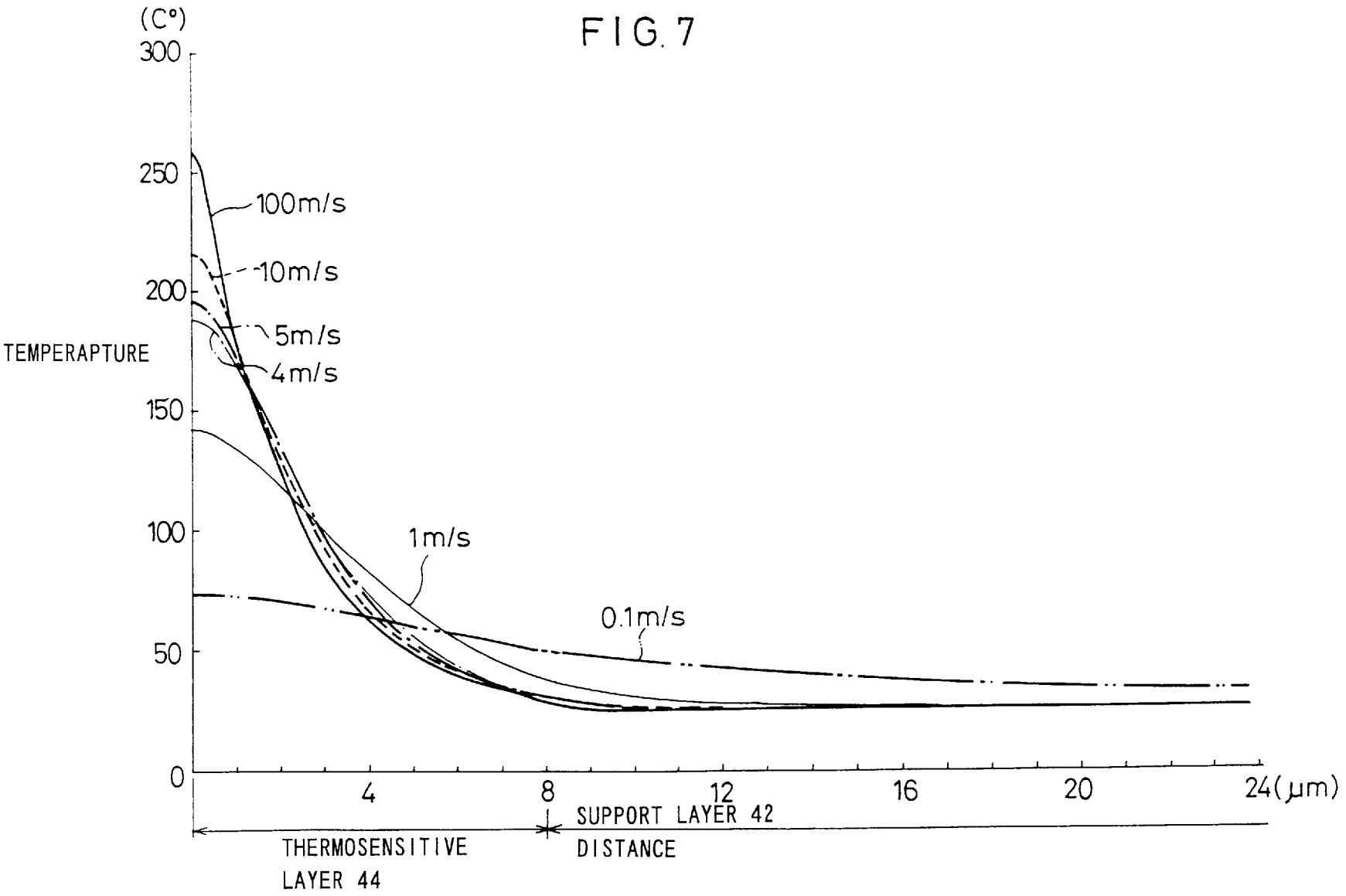
FIG. 7 is a diagram showing the relationship between the distance from the surface of a thermosensitive recording medium having a thickness of 8 μm and the temperature.

FIGS. 6 and 7 show simulated temperature distributions along the thickness of thermosensitive recording mediums S whose thermosensitive layers 44 have respective thicknesses of 4 $\mu$m and 8 $\mu$m when 99% of the light energy of a laser beam L having a beam spot diameter of 100 $\mu$m is absorbed by the thermosensitive layers 44 and an optical density of 2.0 is achieved, at the time a pixel having a size of 100 $\mu$m×10 $\mu$m is formed on the thermosensitive recording mediums S with the laser beam L. The graph shown in each of FIGS. 6 and 7 has a horizontal axis representing the distance from the surface of the thermosensitive layer 44 and a vertical axis representing the temperature thereof immediately after exposure of the thermosensitive recording medium S. The simulated results shown in FIGS. 6 and 7 were obtained when the scanning speed of the laser beam L was of 0.1 m/s, 1 m/s, 4 m/s, 5 m/s, 10 m/s, and 100 m/s.

The simulation model shown in FIGS. 6 and 7 can approximately be expressed as a one-dimensional heat conduction model by establishing the size of pixels and the beam spot diameter of the laser beam L to sufficiently large values with respect to the thickness of the thermosensitive layer 44. In actual systems, the thickness of the thermosensitive layer 44 ranges from 5 $\mu$m to 10 $\mu$m, the size of pixels is of about 100 $\mu$m×100 $\mu$m, and the beam spot diameter ranges from 100 $\mu$m to 150 $\mu$m. In medical applications which require higher accuracy, the size of pixels is of about 50 $\mu$m×50 $\mu$m, and the beam spot diameter ranges from 50 $\mu$m to 100 $\mu$m. Therefore, the one-dimensional heat conduction model is sufficiently applicable to actual systems.

If the scanning speed of the laser beam L is high, e.g., 100 m/s, then the thermal energy generated during exposure is supplied at a rate higher than it is diffused along the thickness of the thermosensitive layer 44 of the thermosensitive recording medium S. Therefore, the temperature gradient in the thermosensitive layer 44 immediately after exposure is large, and the maximum temperature thereof is high. Conversely, if the scanning speed of the laser beam L is low, e.g., 1 m/s, then the thermal energy generated during exposure is supplied at a rate lower than if it is diffused along the thickness of the thermosensitive layer 44. Thus, the temperature gradient in the thermosensitive layer 44 immediately after exposure is small, and the maximum temperature thereof is low. Immediately after exposure when a maximum temperature is achieved, part of the thermal energy is diffused into the support base 42 which does not contribute to coloring, and hence the thermal energy cannot effectively be utilized for heating the thermosensitive layer 44.

The light energy of the laser beam L applied to the thermosensitive recording medium S is converted by the photothermal converting agent contained in the thermosensitive layer 44 into thermal energy, which is applied to make the color developer flowable and also to increase the speed at which the color developer passes through the microcapsules, so that the coloring agent accommodated in the microcapsules and the color developer react with each other, forming a gradation image of given color densities. The rate at which the color developer passes through the microcapsules increases according to the Arrhenius equation which defines the relationship between the rate of diffusion and the temperature. The Arrhenius equation is expressed as:

$$k=A\cdot exp(-E/RT)$$

where k is the diffusion rate constant, R the gas constant, T the absolute temperature, A the frequency factor, and E the apparent activation energy.

Therefore, inasmuch as the rate at which the color developer passes through the microcapsules increases greatly as the temperature rises, the coloring of the thermosensitive recording medium S develops at a higher rate and the produced density increases to a higher degree as the heated temperature thereof is higher.

As a result, it is possible to increase the sensitivity of the thermosensitive recording medium S by increasing the speed at which the thermosensitive recording medium S is scanned by the laser beam L. A study of FIG. 4 indicates that with the laser beam scanning speed set to 5 m/s or higher, an image of desired densities can be recorded on the thermosensitive recording medium S at a high speed with a minimum level of light energy.

Figure 8A:
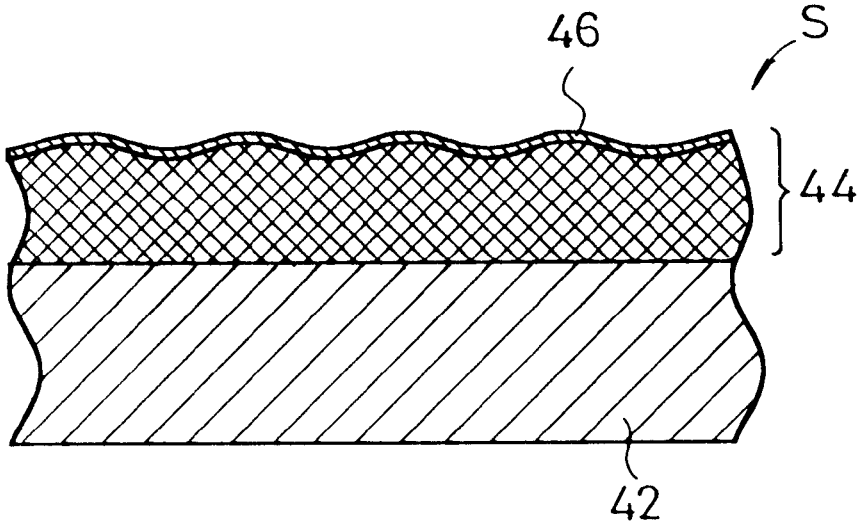
FIG. 8A is a fragmentary cross-sectional view of a coloring region of the thermosensitive recording medium when it is scanned with a laser beam at a low speed.

When the scanning speed of the laser beam L is set to 5 m/s or higher, a sharp temperature gradient is produced along the thickness of the thermosensitive layer 44 for thereby eliminating irregularities in an image recorded on the thermosensitive recording medium S. Specifically, if the scanning speed of the laser beam L is low, no sharp temperature gradient is produced along the thickness of the thermosensitive layer 44. Therefore, no enough density gradient is developed along the thickness of the thermosensitive layer 44, allowing the thermosensitive layer 44 to develop a color fully along its thickness as shown in FIG. 8A. Particularly if the thermosensitive layer 44 is transparent and capable of expressing gradation densities, then thickness irregularities introduced into the thermosensitive layer 44 when the thermosensitive recording medium S is manufactured will appear directly as density irregularities. With the laser beam scanning speed set to 5 m/s or higher, however, since a sharp temperature gradient is produced along the thickness of the thermosensitive layer 44, as described above, there will be developed such a density gradient in the thermosensitive layer 44 that the density is higher toward the surface of the thermosensitive layer 44.

Figure 8B:
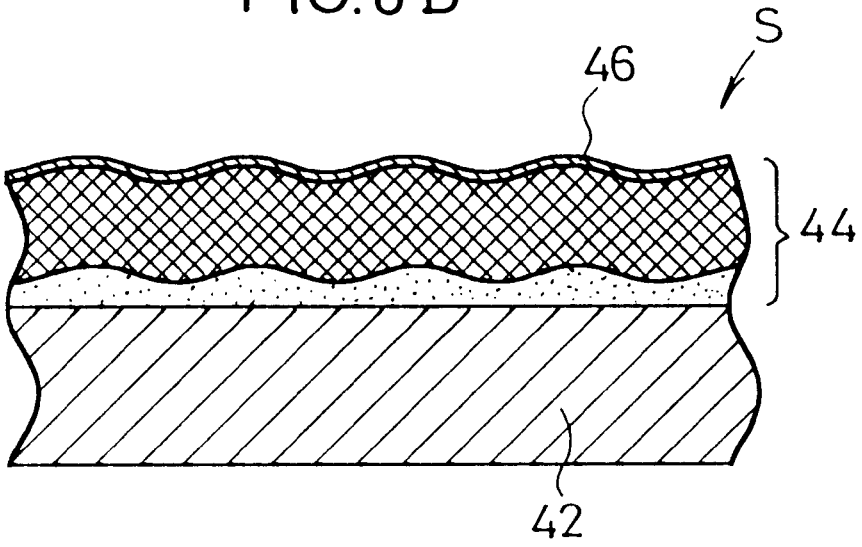
FIG. 8B is a fragmentary cross-sectional view of a coloring region of the thermosensitive recording medium when it is scanned with a laser beam at a high speed.

As a consequence, as shown in FIG. 8B, the thickness of the thermosensitive layer 44 which develops a color with the same thermal energy remains constant, so that no density irregularities will be produced particularly when an image of intermediate densities is recorded on the thermosensitive recording medium S.

By setting the speed at which the thermosensitive recording medium S is scanned by the laser beam L to 5 m/s or higher, thickness irregularities introduced into the thermosensitive layer 44 when the thermosensitive recording medium S is manufactured will not appear as image irregularities. Therefore, an image free of irregularities can be recorded on the thermosensitive recording medium S without appreciably increasing the accuracy with which the thermosensitive recording medium S is manufactured.

When the speed at which the thermosensitive recording medium S is scanned by the laser beam L is set to 5 m/s or higher, therefore, the sensitivity of the thermosensitive recording medium S is maximized, and image irregularities are minimized. As a result, high-quality gradation images can efficiently be recorded on the thermosensitive recording medium S without involving an increase in the output power of the laser beam L.

Because the thermosensitive recording medium S is able to develop a color at a higher speed at a higher temperature, a plurality of laser beams may be combined into a laser beam having a higher density of light energy, and the laser beam having the higher density of light energy may be applied to scan the thermosensitive recording medium S in a shorter period of time for thereby recording an image more efficiently on the thermosensitive recording medium S.

Although a certain preferred embodiment of the present invention has been shown and described in detail, it should be understood that various changes and modifications may be made therein without departing from the scope of the appended claims.

What is claimed is:

1. A method of thermally recording a gradation image on a thermosensitive recording medium S having a photothermal converting agent for converging light energy into thermal energy to develop a color at a density depending on the thermal energy, comprising the steps of:

applying a laser beam having a level of light energy depending on a gradation of an image to be recorded on the thermosensitive recording medium;

scanning the thermosensitive recording medium S with the laser beam at a speed of at least 5 m/s, wherein said thermosensitive recording medium has a transparent thermosensitive layer which contains said photothermal converting agent, a coloring agent accommodated in microcapsules, and a color developer outside of said microcapsules, said microcapsules being permeable to the color developer, the arrangement being such that a speed at which the color developer passes through the microcapsules increases with the thermal energy produced by said photothermal converting agent for allowing said coloring agent and said color developer to react to a predetermined extent with each other for thereby developing a color.

2. A method according to claim 1, wherein a temperature to which the thermosensitive layer is heated by said laser beam is established depending on the speed at which the color developer passes through the microcapsules.

3. A method according to claim 1, further comprising the step of preheating said thermosensitive recording medium to be temperature beyond which the thermosensitive recording medium develops a color before the gradation image is recorded on the thermosensitive recording medium.

4. A method according to claim 1, wherein the speed at which the thermosensitive recording medium is scanned with the laser beam is selected so as to supply the thermal energy to the thermosensitive layer at a rate higher than the thermal energy is diffused along the thickness of the thermosensitive layer.

5. A method according to claim 1, wherein said laser beam comprises a laser beam having a high density of light energy produced by combining a plurality of laser beams.

* * * * *